US012352289B2

(12) United States Patent
Tamao et al.

(10) Patent No.: US 12,352,289 B2
(45) Date of Patent: Jul. 8, 2025

(54) CONTROL DEVICE, VEHICLE, CONTROL METHOD, AND COMPUTER READABLE MEMORY MEDIUM STORING CONTROL PROGRAM

(71) Applicant: TOYOTA JIDOSHA KABUSHIKI KAISHA, Toyota (JP)

(72) Inventors: Junichiro Tamao, Nagoya (JP); Hiromi Yamanashi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 43 days.

(21) Appl. No.: 18/350,021

(22) Filed: Jul. 11, 2023

(65) Prior Publication Data

US 2024/0018975 A1 Jan. 18, 2024

(30) Foreign Application Priority Data

Jul. 14, 2022 (JP) ..... 2022-113415

(51) Int. Cl.

| | |
|---|---|
| ***F04D 29/66*** | (2006.01) |
| ***F04D 19/00*** | (2006.01) |
| ***F04D 27/00*** | (2006.01) |

(52) U.S. Cl.

CPC ..... *F04D 29/663* (2013.01); *F04D 19/002* (2013.01); *F04D 27/004* (2013.01)

(58) Field of Classification Search

CPC .... F04D 29/663; F04D 19/002; F04D 27/004; F05D 2270/333; F05D 2270/80; G10K 11/1752

See application file for complete search history.

(56) References Cited

U.S. PATENT DOCUMENTS

| | | | | |
|---|---|---|---|---|
| 11,551,660 | B1 * | 1/2023 | Baker | B60R 11/0247 |
| 2020/0238902 | A1 * | 7/2020 | Pyzik | B60Q 5/008 |
| 2022/0415299 | A1 * | 12/2022 | Ferguson | G10K 11/1752 |
| 2024/0127782 | A1 * | 4/2024 | Gompertz | G10K 11/34 |
| 2024/0282287 | A1 * | 8/2024 | Kuppers | G10K 11/1752 |

FOREIGN PATENT DOCUMENTS

| | | | |
|---|---|---|---|
| JP | 2010052483 | A | 3/2010 |

* cited by examiner

*Primary Examiner* — Aaron R Eastman
(74) *Attorney, Agent, or Firm* — Dickinson Wright, PLLC

(57) ABSTRACT

A control device is provided with a control section that operates an apparatus on board a vehicle and controls a first frequency, which relates to an operation sound of the apparatus, such that the first frequency corresponds with a second frequency, which relates to an ambient sound in the vehicle.

13 Claims, 7 Drawing Sheets

CONTROL DEVICE, VEHICLE, CONTROL METHOD, AND COMPUTER READABLE MEMORY MEDIUM STORING CONTROL PROGRAM

CROSS-REFERENCE TO RELATED APPLICATION

This application is based on and claims priority under 35 USC 119 from Japanese Patent Application No. 2022-113415 filed on Jul. 14, 2022, the disclosure of which is incorporated by reference herein.

TECHNICAL FIELD

The present disclosure relates to a control device that controls operation of an apparatus, and to a vehicle, a control method, and a computer readable memory medium storing a control program.

RELATED ART

Japanese Patent Application Laid-Open (JP-A) No. 2010-052483 (Patent Document 1) discloses a control device that refers to sound signals memorized in a memory and, in response to anticipated changes in sound volume outputted from a speaker, controls a rotation speed of an on-board cooling fan.

In recent years, with the rapid development of autonomous driving systems, computational complexity in Advanced Driver Assistance System Electronic Control Units (ADAS-ECUs) has increased exponentially. With the increasing computational complexity of ADAS-ECUs, housings of ADAS-ECUs have become larger, and dealing with heat emitted from the housings is a challenge. As one countermeasure, a housing may be disposed within a vehicle cabin (for example, under a seat).

However, acoustic noise emitted from an apparatus such as a cooling fan of an ADAS-ECU disposed in a vehicle cabin or the like may be perceptible even when sound volumes outputted from a speaker are louder than the acoustic noise emitted from the apparatus. Therefore, acoustic noise emitted from the apparatus may be perceived by a user on board the vehicle.

SUMMARY

An object of the present disclosure is to provide a control device, a vehicle, a control method and a control program that may suppress cases of a user on board the vehicle perceiving acoustic noise emitted from an apparatus on board the vehicle.

A control device according to a first aspect includes a control section that operates an apparatus on board a vehicle and controls a first frequency relating to an operation sound of the apparatus such that the first frequency corresponds with a second frequency relating to an ambient sound in the vehicle.

The control device according to the first aspect conducts control to operate the apparatus on board the vehicle such that a frequency of the operation sound of the apparatus corresponds with a frequency of the ambient sound in the vehicle. As a result, cases of acoustic noise emitted from the apparatus being perceived by a user on board the vehicle may be suppressed.

In a control device according to a second aspect, in the control device according to the first aspect, the apparatus includes a rotary mechanism, and the control section controls the first frequency by controlling a rotation speed of the rotary mechanism.

According to the control device according to the second aspect, the frequency from the apparatus may be easily made to correspond with the frequency relating to the ambient sound.

In a control device according to a third aspect, in the control device according to the second aspect, the apparatus is a cooling fan that cools a heat-generating body.

According to the control device according to the third aspect, cases of operating sound from the cooling fan being perceived may be suppressed.

In a control device according to a fourth aspect, in the control device according to the third aspect, the second frequency is at least two frequencies that are specified in advance, and when a cooling request for cooling of the heat-generating body is made, the control section controls the rotary mechanism such that the rotation speed corresponds with a higher frequency of the second frequency.

According to the control device according to the fourth aspect, depending on a state of the heat-generating body, control may be performed so as to further cool the heat-generating body.

In a control device according to a fifth aspect, in the control device according to any one of the first to fourth aspects, the ambient sound includes at least one of a proximity notification sound that gives notice of proximity of the vehicle to surroundings of the vehicle, a cavity resonance sound of a tire provided at the vehicle, and an external sound transmitted through glass in accordance with a coincidence effect, the glass dividing the interior of the vehicle from the exterior.

According to the control device according to the fifth aspect, operation of the apparatus may be controlled so as to correspond with each ambient sound.

A vehicle according to a sixth aspect includes a control device according to any one of the first to fifth aspects and the apparatus.

According to the vehicle according to the sixth aspect, cases of acoustic noise emitted from the apparatus on board the vehicle being perceived by a user on board the vehicle may be suppressed.

A control method according to a seventh aspect includes operating an apparatus on board a vehicle, the operating including controlling a first frequency relating to an operation sound of the apparatus such that the first frequency corresponds with a second frequency relating to an ambient sound in the vehicle.

The control method according to the seventh aspect includes performing control to operate the apparatus on board the vehicle such that a frequency of the operation sound of the apparatus corresponds with a frequency of the ambient sound in the vehicle. Thus, according to this control method, cases of acoustic noise emitted from the apparatus being perceived by a user on board the vehicle may be suppressed.

An information processing program stored by a computer readable memory medium according to an eighth aspect causes a computer to execute processing including operating an apparatus on board a vehicle, the operating including controlling a first frequency relating to an operation sound of the apparatus such that the first frequency corresponds with a second frequency relating to an ambient sound in the vehicle.

The computer executing the control program according to the eighth aspect performs control to operate the apparatus on board the vehicle such that a frequency of the operation sound of the apparatus corresponds with a frequency of the ambient sound in the vehicle. According to this control program, cases of acoustic noise emitted from the apparatus being perceived by a user on board the vehicle may be suppressed.

According to the present disclosure, cases of acoustic noise emitted from an apparatus being perceived by a user on board a vehicle may be suppressed.

DETAILED DESCRIPTION

A control device installed at a vehicle according to the present disclosure is described. The control device is an on-board device and controls operation of a cooling fan that cools an electronic control unit (ECU). A mode of the vehicle according to the present exemplary embodiment that is described is an electric car, a hybrid car or the like in which a motor is installed as a driving unit. The motor drives the vehicle when the vehicle is driven at low speeds (for example, less than 30 km/h). The vehicle is equipped with a function for outputting a proximity notification sound that warns of proximity of the vehicle when the vehicle is running at a low speed.

—Vehicle—

Figure 1:
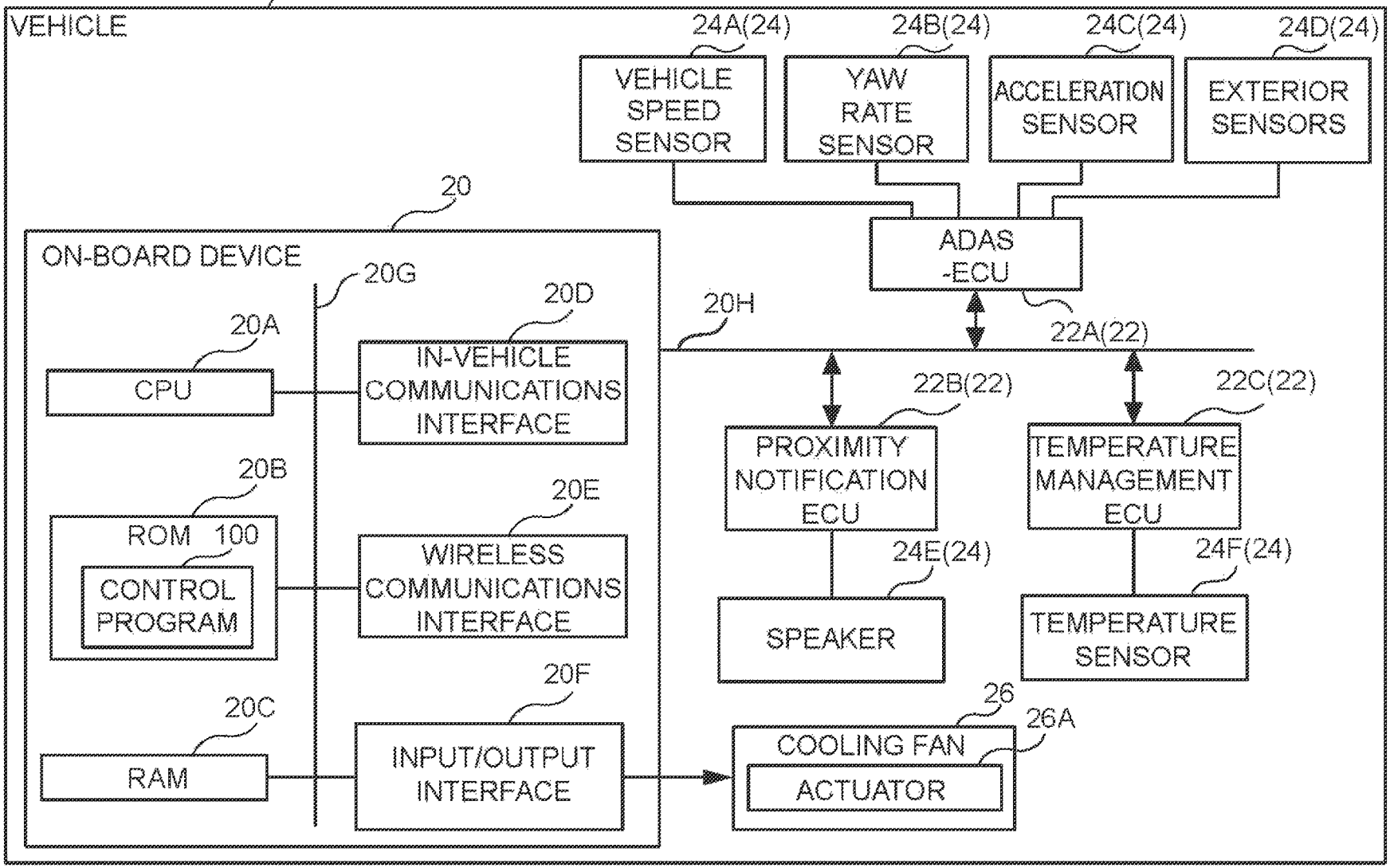
FIG. 1 is a block diagram showing hardware structures of a vehicle according to a present exemplary embodiment.

As shown in FIG. 1, the vehicle 10 according to the present exemplary embodiment includes an on-board device 20, plural electronic control units (ECUs) 22 and plural on-board apparatuses 24.

The on-board device 20 includes a central processing unit (CPU) 20A, read-only memory (ROM) 20B, random access memory (RAM) 20C, an in-vehicle communications interface 20D, a wireless communications interface 20E, and an input/output interface 20F. The CPU 20A, ROM 20B, RAM 20C, in-vehicle communications interface 20D, wireless communications interface 20E and input/output interface 20F are connected to be capable of communications with one another via an internal bus 20G.

The CPU 20A is a central arithmetic processing unit that executes various programs and controls respective parts. That is, the CPU 20A reads a program from the ROM 20B and executes the program, using the RAM 20C as a workspace.

The ROM 20B memorizes various programs and various kinds of data. A control program 100 that controls operation of a cooling fan is memorized at the ROM 20B according to the present exemplary embodiment. In accordance with execution of the control program 100, the on-board device 20 executes processing that controls the cooling fan in response to cooling requests. The RAM 20C serves as a work area and temporarily memorizes programs and data.

The internal communications interface 20D is an interface for connecting with the ECUs 22. This interface employs, for example, a communications standard based on the CAN protocol. The in-vehicle communications interface 20D is connected to an external bus 20H.

The wireless communications interface 20E is a wireless communications module for communicating with an external center server and the like. This wireless communications module employs communications standards such as, for example, 5G, LTE, Wi-Fi (registered trademark) and the like.

The input/output interface 20F is an interface for communicating with a cooling fan 26 installed in the vehicle 10. The cooling fan 26 is equipped with an actuator 26A that activates the fan for cooling an Advanced Driver Assistance System ECU (ADAS-ECU) 22A. The cooling fan 26 may be connected directly to the internal bus 20G. The cooling fan 26 herein is an example of an "apparatus", and the actuator 26A is an example of a "rotary mechanism".

The ECUs 22 include at least the ADAS-ECU 22A, a proximity notification ECU 22B and a temperature management ECU 22C.

The ADAS-ECU 22A conducts supervisory control of advanced driver assistance systems. The ADAS-ECU 22A is connected to a vehicle speed sensor 24A, a yaw rate sensor 24B, an acceleration sensor 24C and exterior sensors 24D, which constitute the on-board apparatuses 24. The vehicle speed sensor 24A is a sensor that detects speeds of the vehicle. The yaw rate sensor 24B is a sensor that detects angular speeds in steering of the vehicle. The acceleration sensor 24C is a sensor that detects accelerations in a progress direction of the vehicle. The exterior sensors 24D are a group of sensors that are used for detecting the environment surrounding the vehicle 10. The exterior sensors 24D include, for example, a camera that images the surroundings of the vehicle 10, a millimeter wave radar that transmits scanning waves and detects reflected waves, a lidar (laser imaging detection and ranging) that scans in front of the vehicle 10, and the like. This ADAS-ECU 22A is an example of a "heat-generating body".

Figure 2:
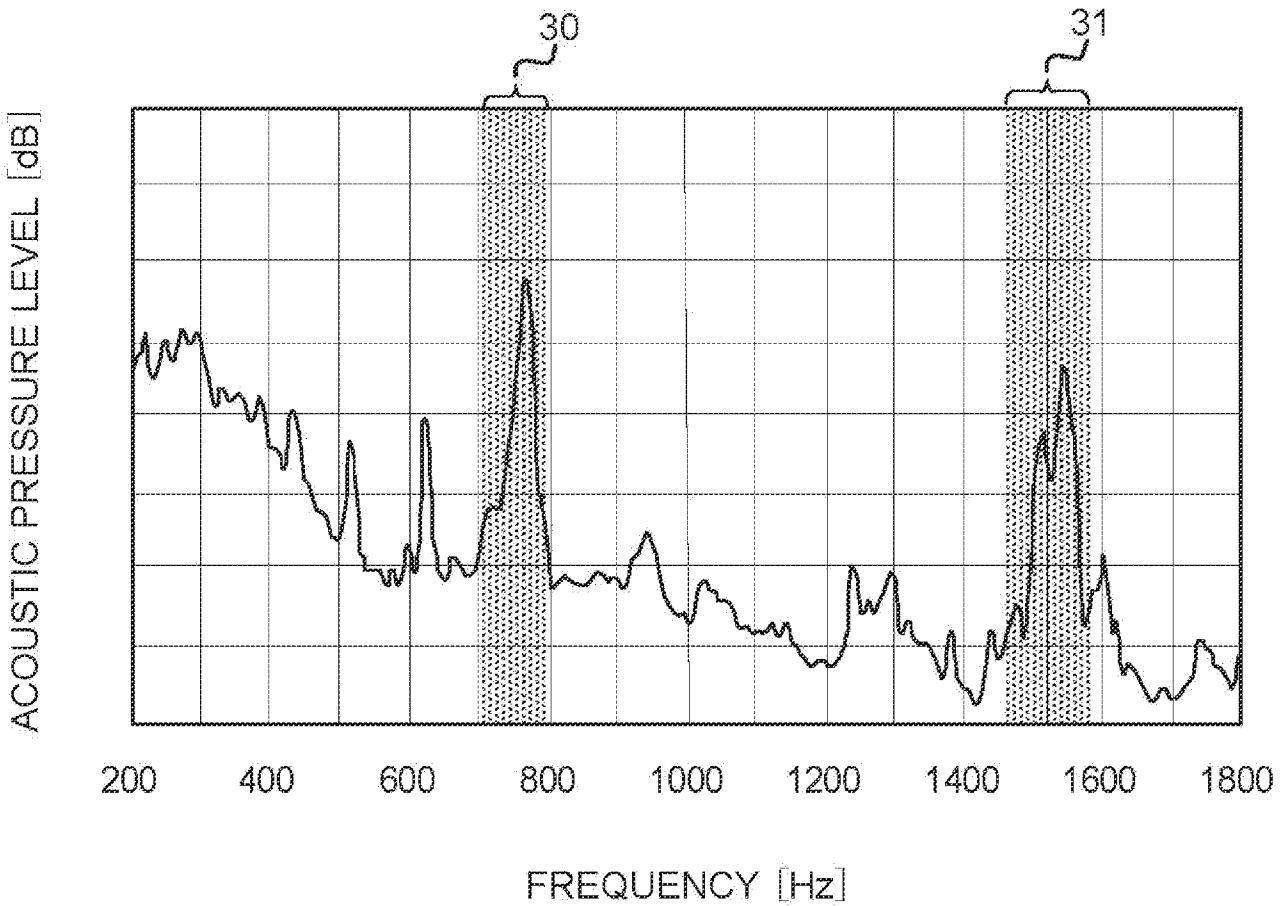
FIG. 2 is a graph showing a relationship between frequencies and acoustic pressure levels of a proximity notification sound according to the present exemplary embodiment.

The proximity notification ECU 22B performs control to output a proximity notification sound when the vehicle 10 is running at low speeds. A speaker 24E is connected to the proximity notification ECU 22B. The speaker 24E outputs the proximity notification sound in response to requests from the proximity notification ECU 22B. Frequencies of a proximity notification sound to be outputted by an electric car, a hybrid car or the like are specified in advance under law. For example, it is stipulated that a proximity notification sound is to include two one-third octave frequency bands in the frequency band from 160 Hz to 5000 Hz. For example, as illustrated in FIG. 2, the proximity notification ECU 22B according to the present exemplary embodiment sends commands to the speaker 24E to output the proximity notification sound in two frequency bands, a frequency band 30 in the vicinity of 800 Hz and a frequency band 31 in the vicinity of 1600 Hz. This proximity notification sound is an example of an "ambient sound", and the frequencies of the proximity notification sound are an example of a "second frequency".

The temperature management ECU 22C performs control to send a cooling request when a temperature of the ADAS-ECU 22A exceeds a predetermined temperature. A temperature sensor 24F is connected to the temperature management ECU 22C. The temperature sensor 24F measures the temperature of the ADAS-ECU 22A.

Figure 3:
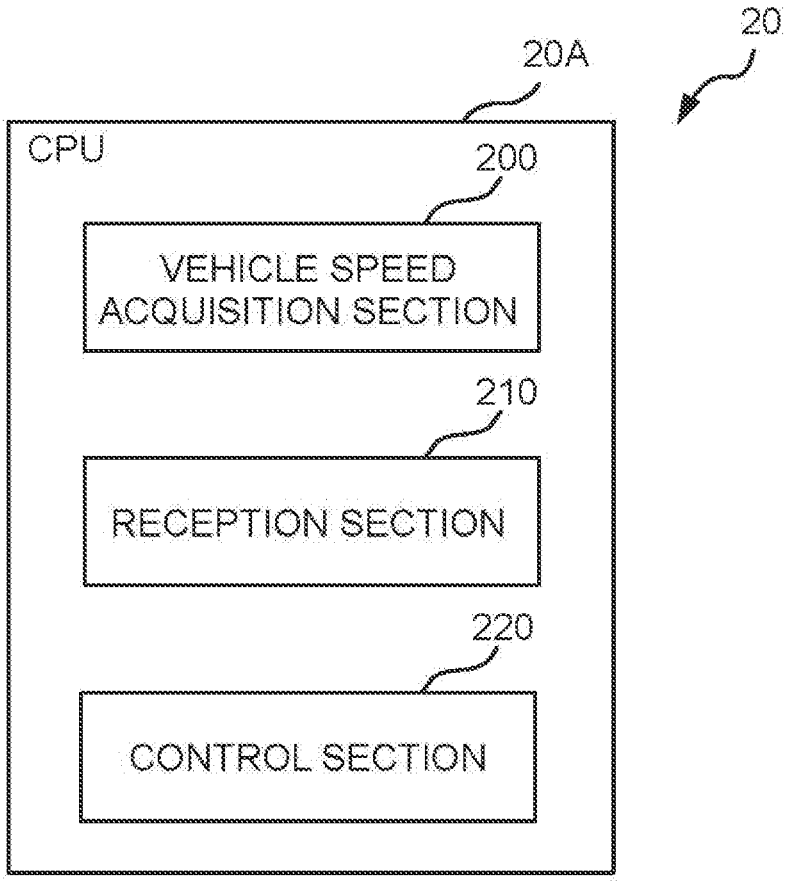
FIG. 3 is a block diagram showing functional structures of an on-board device according to the present exemplary embodiment.

As shown in FIG. 3, by executing the control program 100, the CPU 20A of the on-board device 20 according to the present exemplary embodiment functions as a vehicle speed acquisition section 200, a reception section 210 and a control section 220.

The vehicle speed acquisition section 200 includes a function for acquiring vehicle speeds of the vehicle 10 detected by the vehicle speed sensor 24A from the ADAS-ECU 22A installed at the vehicle 10.

The reception section 210 includes a function for receiving cooling requests sent from the temperature management ECU 22C.

The control section 220 controls activation of the actuator 26A that drives the cooling fan 26 in response to cooling requests received from the reception section 210. More specifically, when the control section 220 has received no cooling request, the control section 220 controls the actuator 26A such that a frequency of acoustic noise from the cooling fan 26 corresponds with the frequency band 30 of the proximity notification sound, and when the control section 220 has received a cooling request, the control section 220 controls the actuator 26A such that a frequency of the acoustic noise from the cooling fan 26 corresponds with the frequency band 31 of the proximity notification sound. These frequencies of acoustic noise from the cooling fan 26 are an example of a "first frequency".

Acoustic pressure levels of the acoustic noise from the cooling fan 26 tend to be greater for a frequency component that is the first order of rotation of the cooling fan 26 and a frequency component that is the order of a number of rotating vanes. The frequency of acoustic noise from the cooling fan 26 in the order of the number of rotating vanes is: frequency=the number of vanes of the cooling fan 26×a rotation speed of the cooling fan 26 (rpm)×1/60 (minutes/seconds).

Figure 4:
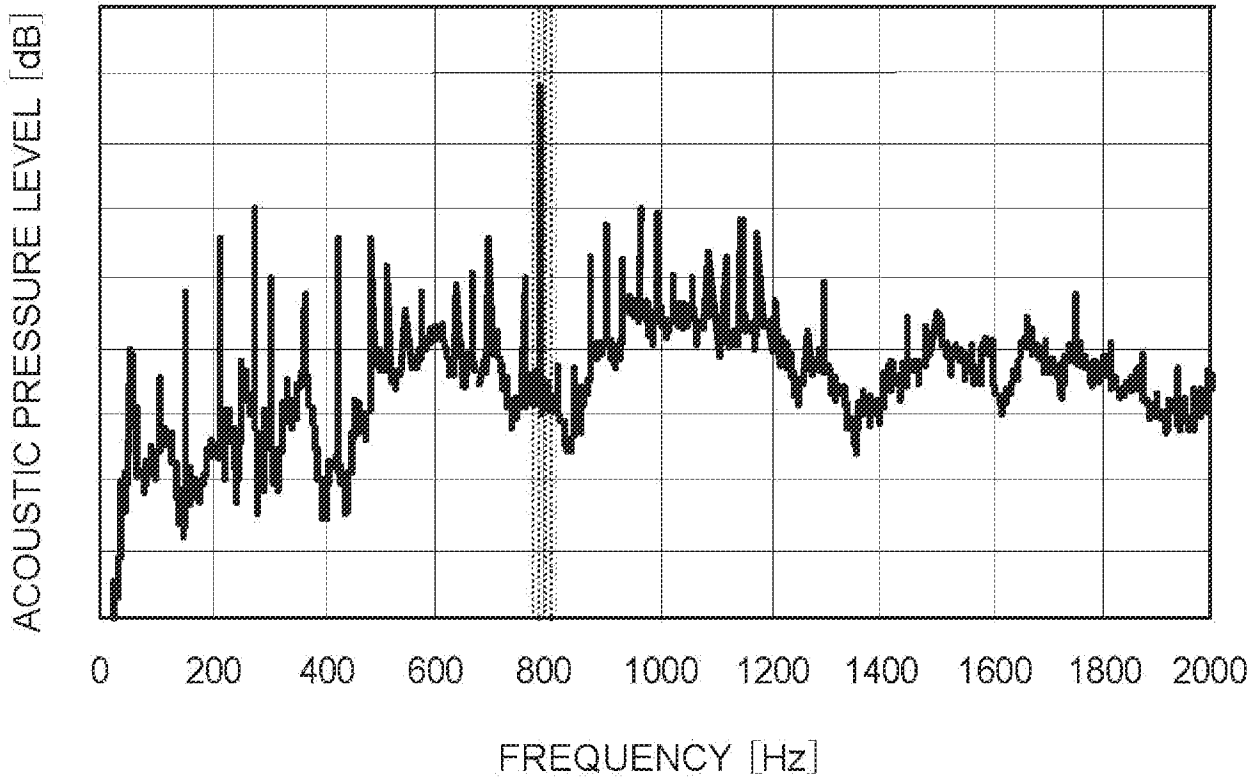
FIG. 4 is a graph showing a relationship between frequencies and acoustic pressure levels of acoustic noise of a cooling fan according to the present exemplary embodiment.

For example, as illustrated in FIG. 4, when the number of vanes of the cooling fan 26 is 21, then if the rotation speed of the cooling fan 26 is 2240 rpm, the acoustic pressure level is at a maximum for a frequency of the acoustic noise of 784 Hz.

That is, if the number of vanes of the cooling fan 26 is 21, then when the vehicle 10 is running at a low speed and is outputting the proximity notification sound, the control section 220 controls the actuator 26A such that the rotation speed of the cooling fan 26 is 2240 Hz in order to correspond with the frequency band 30 of the proximity notification sound. As a result, a frequency of the acoustic noise of the cooling fan 26 is 784 Hz, which corresponds with the frequency band 30 of the proximity notification sound, and the acoustic noise of the cooling fan 26 is masked by the proximity notification sound (a masking effect).

Similarly, if the rotation speed of the cooling fan 26 is 4400 rpm when the number of vanes of the cooling fan 26 is 21, then a frequency of the acoustic noise is 1540 Hz and the acoustic pressure level is large.

If the number of vanes of the cooling fan 26 is 21, then when a cooling request is received, the vehicle 10 is running at a low speed and the vehicle 10 is outputting the proximity notification sound, the control section 220 controls the actuator 26A such that the rotation speed of the cooling fan 26 is 4400 Hz in order to correspond with the frequency band 31 of the proximity notification sound. As a result, a frequency of the acoustic noise of the cooling fan 26 is 1540 Hz, which corresponds with the frequency band 31 of the proximity notification sound, and the acoustic noise of the cooling fan 26 is masked by the proximity notification sound.

In other words, because the frequency of the acoustic noise, which is dependent on the number of vanes and the rotation speed of the cooling fan 26, is specified to correspond with a frequency of the proximity notification sound that is outputted, the acoustic noise from the cooling fan 26 is masked. In order to obtain this masking effect, it is preferable if a frequency at which the acoustic pressure level of the acoustic noise of the cooling fan 26 is at a peak matches a frequency at which the acoustic pressure level of the proximity notification sound is at a peak. However, the masking effect can be obtained if the frequency at which the acoustic pressure level of the acoustic noise of the cooling fan 26 is at a peak is within a range of a frequency band of the proximity notification sound.

—Flow of Control—

Figure 5:
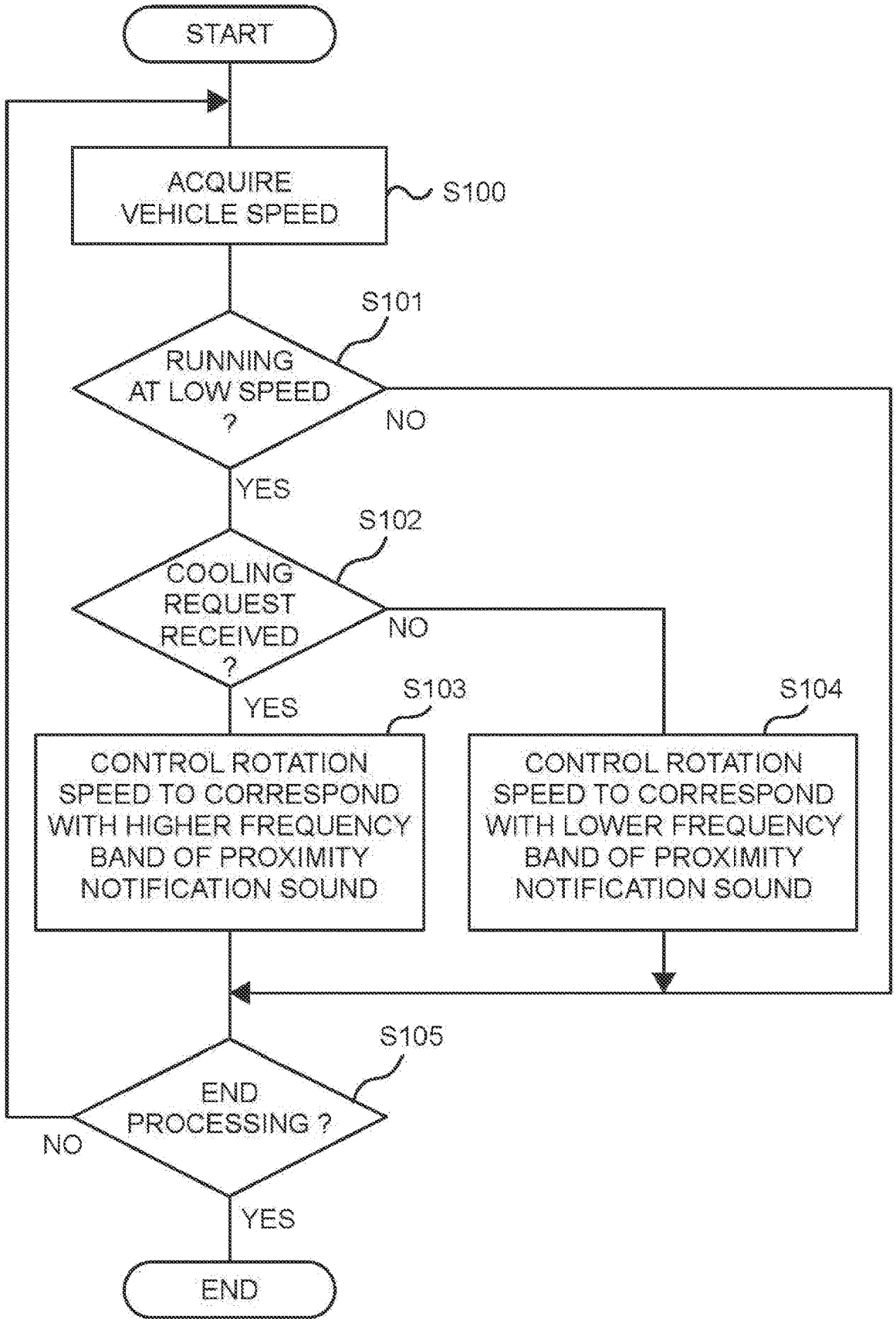
FIG. 5 is a flowchart showing a flow of processing to control a rotation speed of the cooling fan, which is executed at the vehicle according to the present exemplary embodiment.

A flow of control that is executed at the on-board device 20 according to the present exemplary embodiment is described using the flowchart of FIG. 5. The processing at the on-board device 20 is implemented by the CPU 20A of the on-board device 20 functioning as the vehicle speed acquisition section 200, the reception section 210 and the control section 220. The processing controlling the cooling fan 26 that is shown in FIG. 5 is executed, for example, when an engine of the vehicle 10 starts and a command controlling the cooling fan 26 is inputted.

In step S100, the CPU 20A acquires a vehicle speed of the vehicle 10 from the ADAS-ECU 22A.

In step S101, the CPU 20A makes a determination as to whether the vehicle 10 is running at a low speed. When the vehicle 10 is running at a low speed (Yes in step S101), the CPU 20A proceeds to step S102. Alternatively, when the vehicle 10 is not running at a low speed (No in step S101), the CPU 20A proceeds to step S105.

In step S102, the CPU 20A makes a determination as to whether a cooling request has been received from the temperature management ECU 22C. When a cooling request has been received (Yes in step S102), the CPU 20A proceeds to step S103. Alternatively, when no cooling request has been received (No in step S102), the CPU 20A proceeds to step S104.

In step S103, the CPU 20A controls the rotation speed of the cooling fan 26 such that a frequency of acoustic noise of the cooling fan 26 corresponds with the frequency band 31 that is at a higher frequency in the frequency bands of the proximity notification sound.

In step S104, the CPU 20A controls the rotation speed of the cooling fan 26 such that a frequency of acoustic noise of the cooling fan 26 corresponds with the frequency band 30 that is at a lower frequency in the frequency bands of the proximity notification sound.

In step S105, the CPU 20A makes a determination as to whether the processing controlling the rotation speed of the cooling fan 26 is to end. When the processing controlling the rotation speed of the cooling fan 26 is to end (Yes in step S105), the CPU 20A ends the processing controlling the rotation speed of the cooling fan 26. Alternatively, when the processing controlling the rotation speed of the cooling fan 26 is not to end (No in step S105), the CPU 20A proceeds to step S100 and acquires the vehicle speed.

Overview of the Exemplary Embodiment

The on-board device 20 that serves as the control device according to the present exemplary embodiment implements control to operate an apparatus on board the vehicle such that a frequency of an operation sound of the apparatus corresponds with a frequency of an ambient sound in the vehicle.

According to the present exemplary embodiment described above, cases of a user on board the vehicle perceiving acoustic noise emitted from the apparatus may be suppressed.

First Variant Example of the Exemplary Embodiment

In the exemplary embodiment described above, a mode is described in which the proximity notification sound is used to mask the acoustic noise emitted from the cooling fan 26. However, this is not limiting. The acoustic noise emitted from the cooling fan 26 may be masked by using an alternative ambient sound.

For example, as an alternative ambient sound, the acoustic noise emitted from the cooling fan 26 may be masked using a frequency (below referred to as a coincidence frequency) of external sounds that is transmitted through glass separating the interior of the vehicle 10 from the exterior in accordance with the coincidence effect. The coincidence effect is a phenomenon in which, when external sounds are incident on a windshield glass of the vehicle 10, transmission losses in the vicinity of a particular frequency are small due to resonance (and external sound is transmitted). The coincidence frequency transmitted through the windshield glass can be represented by the following mathematical expression.

$$f_\theta = \frac{c^2}{2\pi h \sin^2\theta}\sqrt{\frac{12(1-\rho^2)}{E}} \tag{1}$$

In this expression, $f_\theta$ represents the coincidence frequency, c represents the speed of sound, h represents a plate thickness of the windshield glass of the vehicle 10, ρ represents the density of the windshield glass, and E represents the Young's modulus of the windshield glass. The symbol θ represents an angle between the windshield glass and an external sound.

Figure 6:
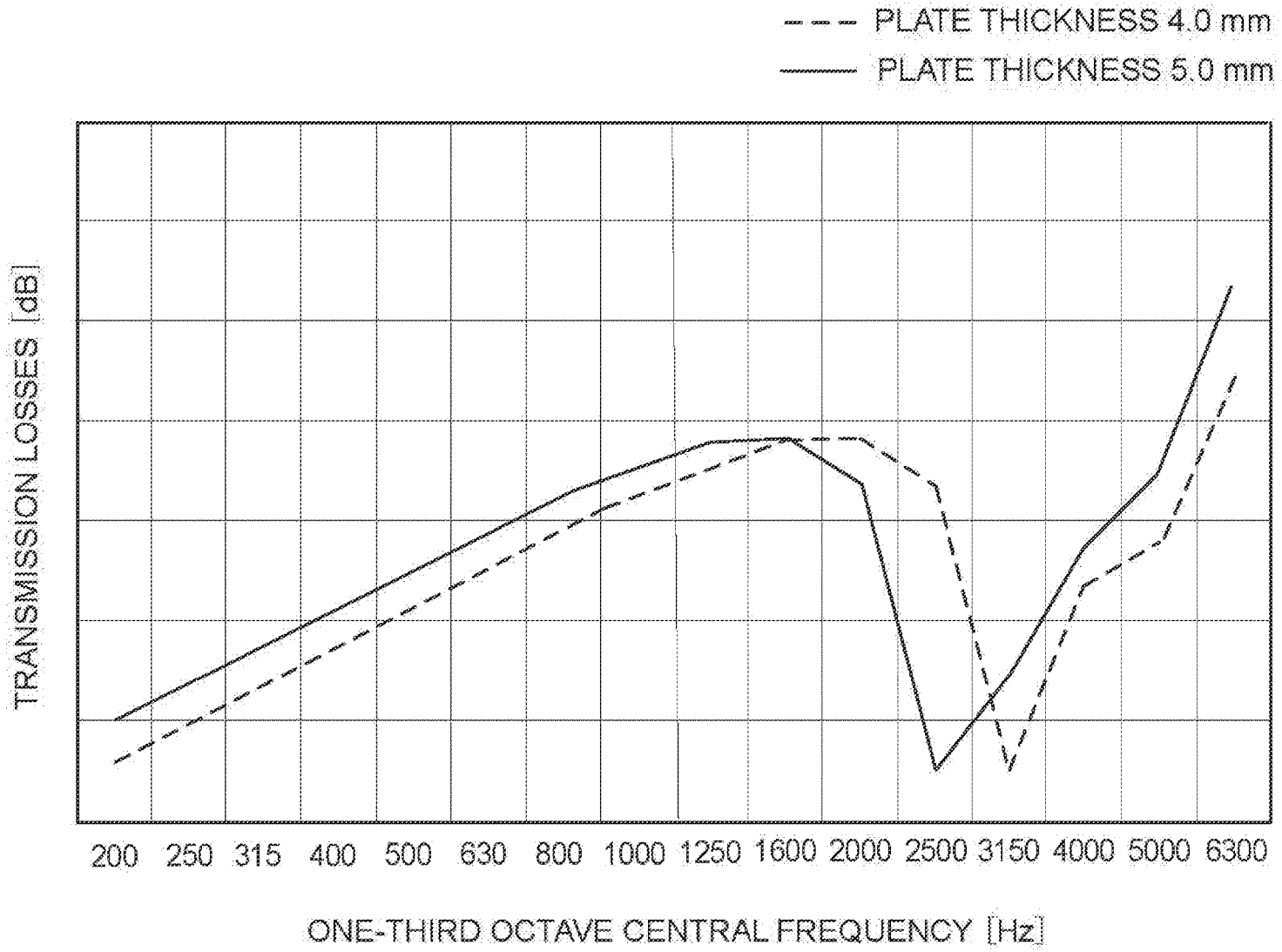
FIG. 6 is a graph showing a relationship between frequencies and transmission losses of external sounds, to aid description of a coincidence effect according to the present exemplary embodiment.

According to the above expression (1), given the same material of the windshield glass, then the greater the plate thickness, the lower the confidence frequency transmitted through the windshield glass. For example, as illustrated in FIG. 6, when the plate thickness of the windshield glass is 5.0 mm, transmission losses are smaller in the vicinity of a one-third octave frequency band central frequency of 2400 Hz, and this frequency is more likely to reach a user on board the vehicle 10. When the plate thickness of the windshield glass is 4.0 mm, transmission losses are smaller in the vicinity of a one-third octave frequency band central frequency of 3000 Hz, and this frequency is more likely to reach a user on board the vehicle 10.

That is, the coincidence frequency that is transmitted through the windshield glass of the vehicle 10 and is perceptible within the vehicle cabin can be estimated in accordance with the plate thickness of the windshield glass. The control section 220 in FIG. 3 controls the actuator 26A such that the cooling fan 26 emits acoustic noise with a frequency corresponding to the estimated coincidence frequency. As a result, the acoustic noise of the cooling fan 26 is masked by external sounds. In the present exemplary embodiment, a mode is described in which the acoustic noise of the cooling fan 26 is masked by external sound transmitted through the windshield glass, but this is not limiting. The acoustic noise may be masked by external sound transmitted through a door glass.

Second Variant Example of the Exemplary Embodiment

In the first variant example of the exemplary embodiment described above, a mode is described in which the acoustic noise of the cooling fan 26 is masked by using external sound transmitted by the coincidence effect as an alternative ambient sound. In the present variant example, a mode is described in which the acoustic noise of the cooling fan 26 is masked by using cavity resonance sound of tires of the vehicle 10 as an alternative ambient sound.

In a structure such as, for example, a tire inside which a cavity is formed, resonant sound (below referred to as cavity resonance sound) is produced by resonance due to air oscillating inside the structure. A frequency of the cavity resonance sound when the structure is a tire can be represented by the following mathematical expression.

$$f = \frac{c}{2\pi a\left\{\frac{r_d - r}{2} + r\right\}} \tag{2}$$

Figure 7:
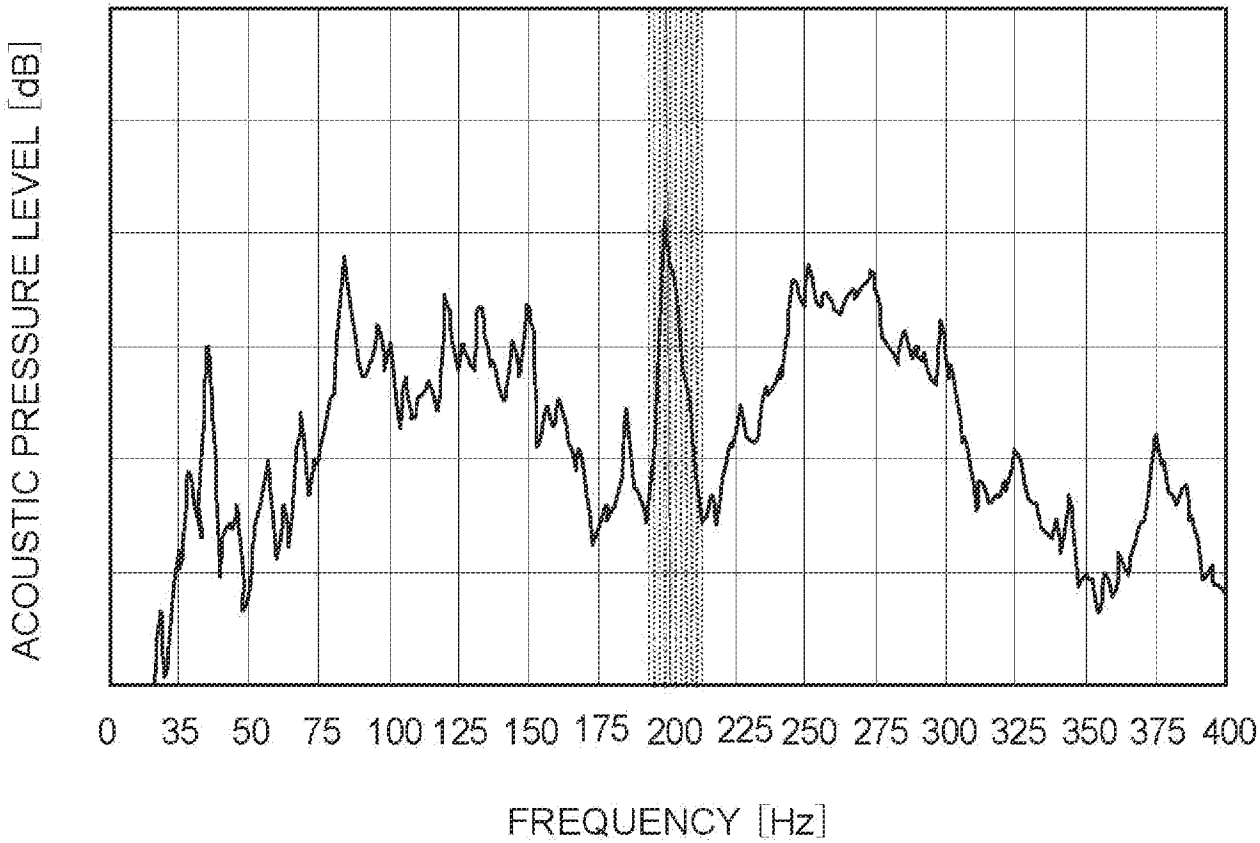
FIG. 7 is a graph showing a relationship between frequencies and acoustic pressure levels of cavity resonance sound of a tire according to the present exemplary embodiment.

In this expression, f represents the frequency of the cavity resonance sound, $r_d$ represents a dynamic load radius of the tire, r represents a wheel radius of the tire, and a represents an adjustment factor. For example, as illustrated in FIG. 7, when running at a vehicle speed of 60 km/h, resonant sound of the tire is emitted with a maximum acoustic pressure level in the vicinity of 200 Hz.

That is, a frequency of cavity resonance sound of the tire that is perceptible within the vehicle cabin can be estimated in accordance with a wheel radius of the vehicle 10 and a dynamic load radius at a vehicle speed. The control section 220 in FIG. 3 controls the actuator 26A such that the cooling fan 26 emits acoustic noise with a frequency corresponding to the estimated frequency of the cavity resonance sound of the tire. As a result, the acoustic noise of the cooling fan 26 is masked by the cavity resonance sound.

Overview of the Variant Examples

The on-board device 20 that serves as the control device according to the present exemplary embodiment implements control to operate the apparatus on board the vehicle such that a frequency of an operation sound of the apparatus corresponds with a coincidence frequency of the vehicle 10 or a frequency of cavity resonance sound of tires of the vehicle 10.

According to the present exemplary embodiment described above, cases of a user on board the vehicle perceiving acoustic noise emitted from the apparatus may be suppressed.

=Remarks=

In the exemplary embodiment described above, modes are described in which acoustic noise emitted from the cooling fan 26 is masked by using the proximity notification sound, external sound according to the coincidence effect, and cavity resonance sound of tires as ambient sounds. However, this is not limiting. Acoustic noise emitted from the cooling fan 26 may be masked by using alternative ambient sounds. For example, engine sound, motor sound and the like of the vehicle 10 may be used to mask the acoustic noise emitted from the cooling fan 26.

In the exemplary embodiment described above, modes are described in which acoustic noise emitted from the cooling fan 26 is masked, but this is not limiting. For example, engine sound, motor sound, operating sound of an air conditioner of the vehicle 10 and the like may be masked.

According to the exemplary embodiment described above, modes are described in which the vehicle 10 is an electric car, a hybrid car or the like, but this is not limiting. The vehicle may be any vehicle provided that a proximity notification sound, external sound according to the coincidence effect, or cavity resonance sound of tires can be produced.

In the exemplary embodiment described above, modes are described in which the on-board device 20 controls the cooling fan 26, but this is not limiting. The cooling fan 26 may be controlled by an external server. For example, the on-board device 20 may transmit vehicle speeds of the vehicle 10 and cooling requests to this server, and the on-board device may control the cooling fan 26 on the basis of determination results received from this server.

According to the exemplary embodiment described above, a mode is described in which the proximity notification sound is in two frequency bands, the frequency band 30 in the vicinity of 800 Hz and the frequency band 31 in the vicinity of 1600 Hz. However, this is not limiting. The proximity notification sound may be in any frequency band provided the proximity notification sound includes two one-third octave frequency bands in the frequency band from 160 Hz to 5000 Hz.

In the exemplary embodiment described above, the CPU 20A reads and executes software (a program) but various processes may be executed by various kinds of processor other than a CPU. Examples of processors in these cases include a PLD (programmable logic device) in which a circuit configuration can be modified after manufacturing, such as an FPGA (field programmable gate array) or the like, a dedicated electronic circuit which is a processor with a circuit configuration that is specially designed to execute specific processing, such as an ASIC (application-specific integrated circuit) or the like, and so forth. The processing described above may be executed by one of these various kinds of processors, and may be executed by a combination of two or more processors of the same or different kinds (for example, plural FPGAs, a combination of a CPU with an FPGA, or the like). Hardware structures of these various kinds of processors are, to be more specific, electronic circuits combining circuit components such as semiconductor components and the like.

In the exemplary embodiment described above, modes are described in which a program is memorized in advance (installed) on a computer readable non-transitory recording medium. For example, the control program 100 of the on-board device 20 is memorized in advance at the ROM 20B. However, this is not limiting and a program may be provided in a mode of being recorded on a non-transitory recording medium such as a CD-ROM (compact disc read-only memory), DVD-ROM (digital versatile disc read-only memory), USB (universal serial bus) memory or the like. Modes are also possible in which a program is downloaded from external equipment via a network.

The flow of processing described in the above exemplary embodiment is an example. Unnecessary steps may be removed, new steps may be added, and processing sequences may be rearranged within a scope not departing from the gist of the disclosure.

What is claimed is:

1. A control device comprising at least one processor that is configured to:

operate an apparatus on board a vehicle;

depending on a state of the vehicle and an operation mode of the apparatus, select one from among a plurality of second frequencies associated with a frequency band of an ambient sound in the vehicle; and control a first frequency associated with a frequency band of an operation sound of the apparatus such that the first frequency corresponds with the selected second frequency to mask the operation sound of the apparatus by the ambient sound in the vehicle by masking effect;

wherein the at least one processor selects one from among a plurality of second frequencies associated with a frequency band of an ambient sound in the vehicle, when the vehicle is running at low speeds, and the manner of selection depends on an instruction that the apparatus receives from a user.

2. The control device according to claim 1, wherein the apparatus includes a rotary mechanism, and the at least one processor is configured to control the first frequency by controlling a rotation speed of the rotary mechanism.

3. The control device according to claim 2, wherein the apparatus is a cooling fan that cools a heat-generating body.

4. The control device according to claim 3, wherein the second frequency is at least two frequencies that are specified in advance, and the at least one processor is configured to control the rotary mechanism such that the rotation speed corresponds with a higher frequency among the frequencies, when a cooling request for cooling of the heat-generating body is made.

5. A vehicle comprising:

a control device according to claim 3; and the apparatus.

6. A vehicle comprising:

a control device according to claim 4; and the apparatus.

7. A vehicle comprising:

a control device according to claim 2; and the apparatus.

8. The control device according to claim 1, wherein the ambient sound includes at least one of a proximity notification sound that gives notice of proximity of the vehicle to surroundings of the vehicle, a cavity resonance sound of a tire provided at the vehicle, and an external sound transmitted through glass in accordance with a coincidence effect, the glass dividing the interior of the vehicle from the exterior.

9. A vehicle comprising:

a control device according to claim 5; and the apparatus.

10. A vehicle comprising:

a control device according to claim 1; and the apparatus.

11. The control device according to claim 1, wherein the plurality of second frequencies are a plurality of peak frequencies having peak acoustic pressures in a frequency band of the ambient sound.

12. A control method in which a computer executes processing comprising:

operating an apparatus on board a vehicle, depending on a state of the vehicle and an operation mode of the apparatus, selecting one from among a plurality of second frequencies associated with a frequency band of an ambient sound in the vehicle; and controlling a first frequency associated with a frequency band of an operation sound of the apparatus such that the first frequency corresponds with the selected second frequency to mask the operation sound of the apparatus by the ambient sound in the vehicle by masking effect;

wherein the selecting comprises selecting one from among a plurality of second frequencies associated with a frequency band of an ambient sound in the vehicle, when the vehicle is running at low speeds, and the manner of selection depends on an instruction that the apparatus receives from a user.

13. A non-transitory computer readable memory medium storing a control program that is executable by a computer to execute processing comprising:

operating an apparatus on board a vehicle, depending on a state of the vehicle and an operation mode of the apparatus, selecting one from among a plurality of second frequencies associated with a frequency band of an ambient sound in the vehicle; and controlling a first frequency associated with a frequency band of an operation sound of the apparatus such that the first frequency corresponds with the selected second frequency to mask the operation sound of the apparatus by the ambient sound in the vehicle by masking effect;

wherein the selecting comprises selecting one from among a plurality of second frequencies associated with a frequency band of an ambient sound in the vehicle, when the vehicle is running at low speeds, and the manner of selection depends on an instruction that the apparatus receives from a user.

* * * * *